US008439694B2

(12) United States Patent
Yeh et al.

(10) Patent No.: US 8,439,694 B2
(45) Date of Patent: May 14, 2013

(54) SOCKET WITH PICK UP CAP WITH A PIVOT HAVING A LONG SIDE AND A SHORT SIDE

(75) Inventors: Cheng-Chi Yeh, New Taipei (TW); Andrew Cheng, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 2 days.

(21) Appl. No.: 13/303,036

(22) Filed: Nov. 22, 2011

(65) Prior Publication Data

US 2012/0142209 A1 Jun. 7, 2012

(51) Int. Cl.
*H01R 13/44* (2006.01)

(52) U.S. Cl.
USPC ..... 439/135

(58) Field of Classification Search ..... 439/133, 439/135, 331, 41
See application file for complete search history.

(56) References Cited

U.S. PATENT DOCUMENTS

| | | | | |
|---|---|---|---|---|
| 7,001,197 | B2 * | 2/2006 | Shirai et al. | 439/331 |
| 7,070,428 | B2 * | 7/2006 | Ma | 439/135 |
| 8,052,439 | B2 * | 11/2011 | Fan et al. | 439/135 |
| 8,142,201 | B2 * | 3/2012 | Fan | 439/41 |

* cited by examiner

*Primary Examiner* — Chandrika Prasad
(74) *Attorney, Agent, or Firm* — Wei Te Chung; Ming Chieh Chang

(57) ABSTRACT

A socket comprises an insulating housing receiving a plurality of contacts, and a pick-up cap engaging with the insulating housing. The pick-up cap has a planar main body covering the insulating housing. The main body is formed with two pivots on a side thereof. The insulating housing is formed with a plurality of sidewalls, one of the sidewall is provided with a pair of mounting seats on an outside thereof, each mounting seat defines a mounting hole with a gap, and the pivots of the pick-up cap enter into the mounting holes via the gaps to pivotally assemble the pick-up cap to the mounting seats.

11 Claims, 13 Drawing Sheets

SOCKET WITH PICK UP CAP WITH A PIVOT HAVING A LONG SIDE AND A SHORT SIDE

BACKGROUND OF THE INVENTION

1. Field of the Invention

The present invention relates to socket, more particularly to a socket electrically connecting an IC package to a printed circuit board.

2. Description of Related Art

U.S. Pat. No. 7,001,197 issued on Feb. 21, 2006, discloses a traditional socket for electrically connecting an IC package to a printed circuit board. The socket comprises an insulative housing, a plurality of contacts received in the insulative housing, a frame disposed around the insulative housing, a loading plate pivotally assembled to an end of the frame and a loading lever pivotally assembled to an opposite end of the frame. The socket usually is equipped with a pick up cap, the pick up cap can be assembled to the loading plate, the frame or the insulative housing, the pick up cap has two functions, one is to provide a smooth surface for sucking by a pick up tool to move the socket, the other is to protect the terminals received in the socket from exterior dust or outside force.

The pick up cap of the socket needs to be removed before using, operator commonly directly upwardly picks the pick up cap disposed upon the insulative housing by fingers, however, once the operator makes a mistake during this process, the pick up cap will drop down and crash the contacts, that may destroy the socket.

Hence, an improved socket is desired to overcome the above problems.

BRIEF SUMMARY OF THE INVENTION

According to the present invention, a socket comprises an insulative housing receiving a plurality of contacts and a pick up cap assembled to the insulative housing. The insulative housing has a plurality of sidewalls and at least one mounting seat formed on one of the sidewalls and defining a mounting hole with a gap. The pick up cap is formed with at least one pivot disposed on a side thereof, the pivot inserting into the mounting hole via the gap to pivotally assemble the pick up cap to the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
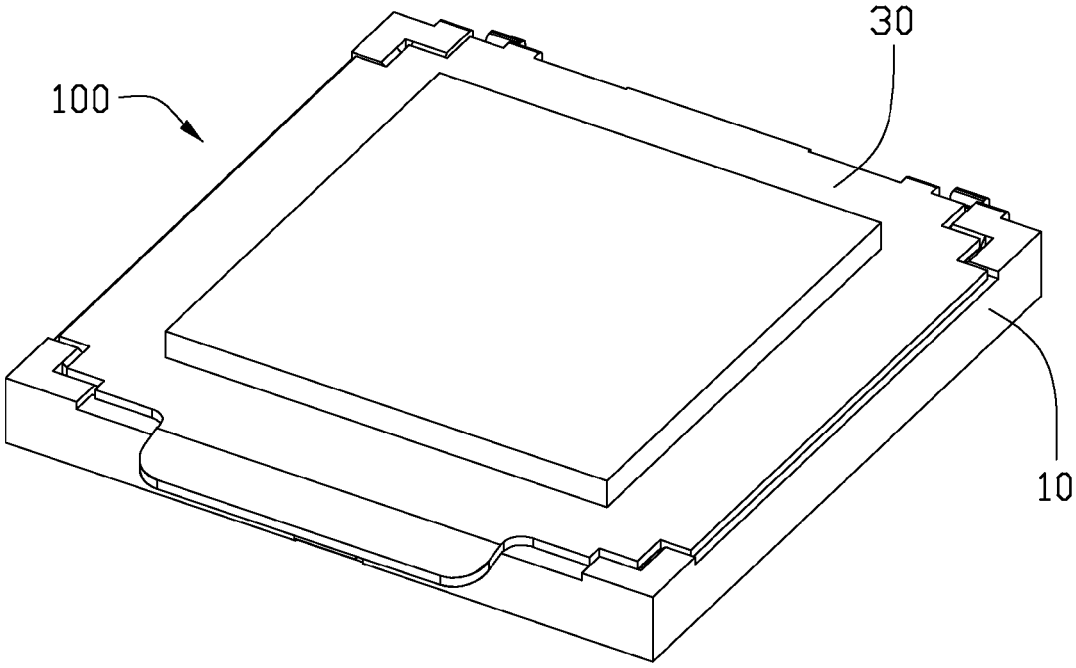
FIG. 1 is an assembled, perspective view of a socket according to a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
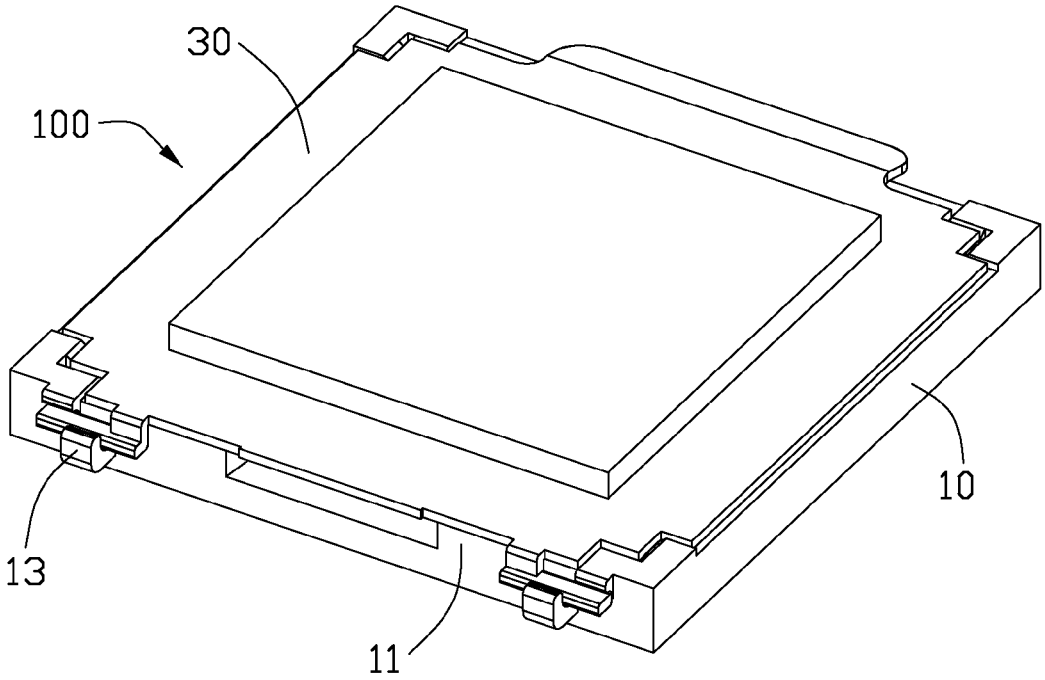
FIG. 2 is a view similar to FIG. 1, while taken from a different aspect.

FIGS. 1-8 describe a socket 100 according to a first embodiment of present invention. Referring to FIGS. 1 and 2, the socket 100, adapted for electrically connecting an IC package (not shown) to a printed circuit board (not shown), comprises an insulative housing 10, a plurality of contacts (not shown) received within the insulative housing 10 and a pick up cap 30 assembled on the insulative housing 10.

The insulative housing 10 being a substantial rectangular shape, has a plurality of sidewalls 11 extending upwardly from a peripheral thereof, and a receiving cavity 12 recessed downwardly from the top surface of the insulative housing 10, the contacts are arranged in matrix in the receiving cavity 12. The insulative housing 10 has a pair of mounting seats 13 outside two ends of one of the sidewalls 11 to assemble the pick up cap 30.

Figure 3:
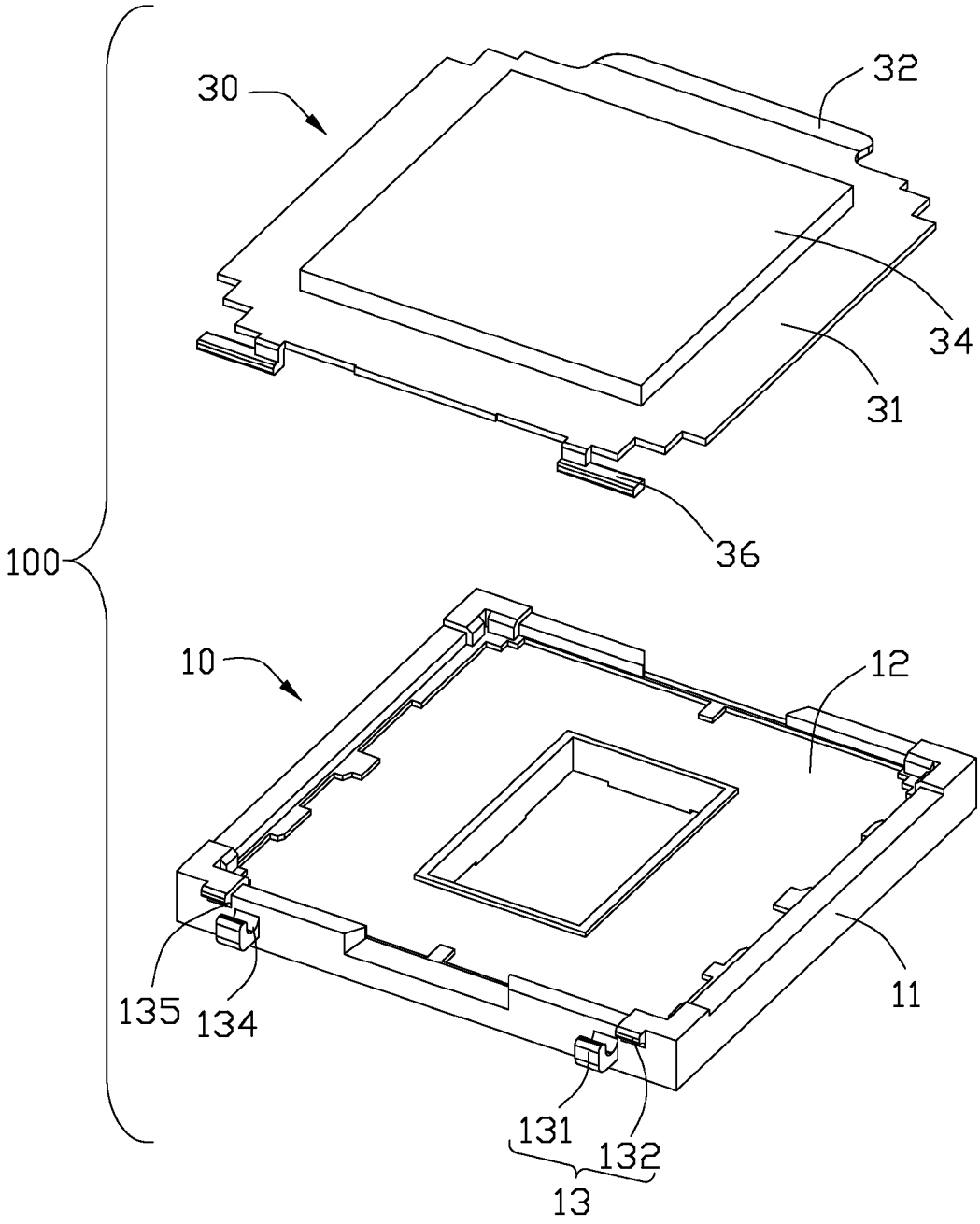
FIG. 3 is an exploded, perspective view of the socket.
Figure 4:
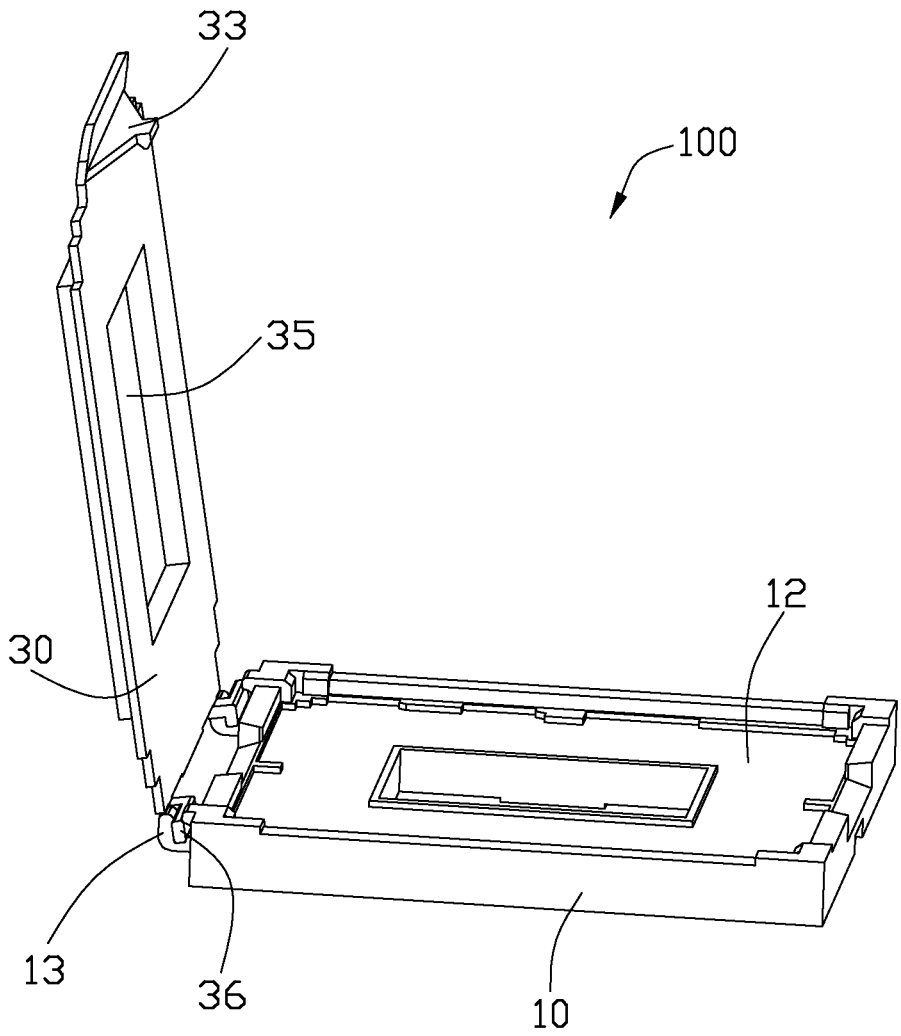
FIG. 4 is another perspective view of the socket in an opening state.
Figure 5:
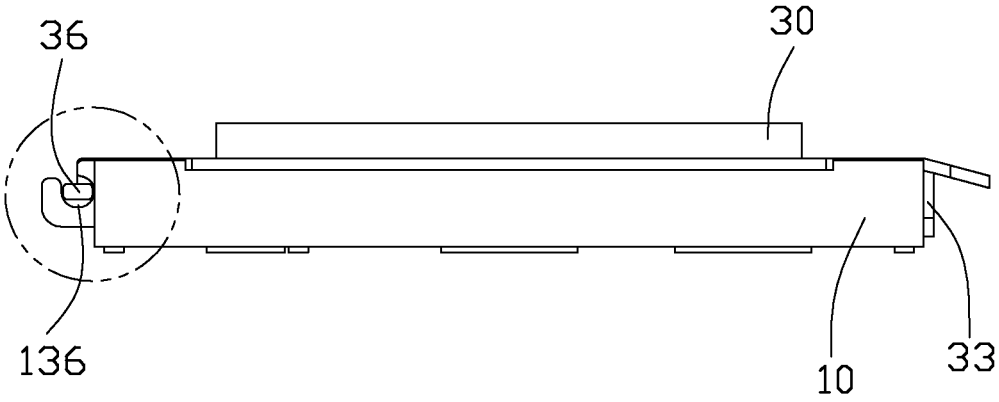
FIG. 5 is a side view of the socket shown in FIG. 2.

Referring to FIGS. 3 to 5, the mounting seat 13 has a base 131 and an accessorial seat 132 both protruding outwardly from an outside surface of the sidewalls 11. The base 131 defines a first recess 134 opening upwardly, the accessorial seat 132 defines a second recess 135 opening downwardly, wherein the accessorial seat 132 staggers with the base 131 along an extending direction of the sidewall 11 and the accessorial seat 132 is located beyond the base 131. The first recess 134 and the second recess 135 cooperatively defines a mounting hole 136, which substantially has a circular section and is situated outside the sidewall 11.

The pick up cap 30 and the insulative housing 10 have substantial equal areas, the pick up cap 30 is formed with a planar main body 31 covering the receiving cavity 12 and an operating portion 32 located beside of the main body 31. The operating portion 32 projects from an edge of the main body 31 for being picked by fingers of operator. The operating portion 32 is formed with a latching arm 33 extending downwardly from a bottom thereof. The main body 31 has a protrusion 34 in the center thereof and a depression 135 on back of the protrusion 34 for receiving a top of the IC package in the cavity 12 of the insulative housing 10. The main body 31 further has a pair of pivots 36 on two opposite ends of the other edge of the main body 31 opposite to the operating portion 32. The pivot 36 is located below the main body 31 and horizontally extending outwardly along the other edge. The pivot 36 has a rectangular section and received in the mounting hole 136 of the mounting seat 13 of the insulative housing 10 to pivot the pick up cap 30 to the insulative housing 10.

FIG. 5 shows a side view of the pick up cap 30 located at a horizontal position, the pick up cap 30 at this position covers the insulative housing 10, the pivots 36 stays in the mounting hole 136, and the latching arm 33 latches the insulative housing 10 as so to retain the pick up cap 30 at the horizontal position.

Figure 6:
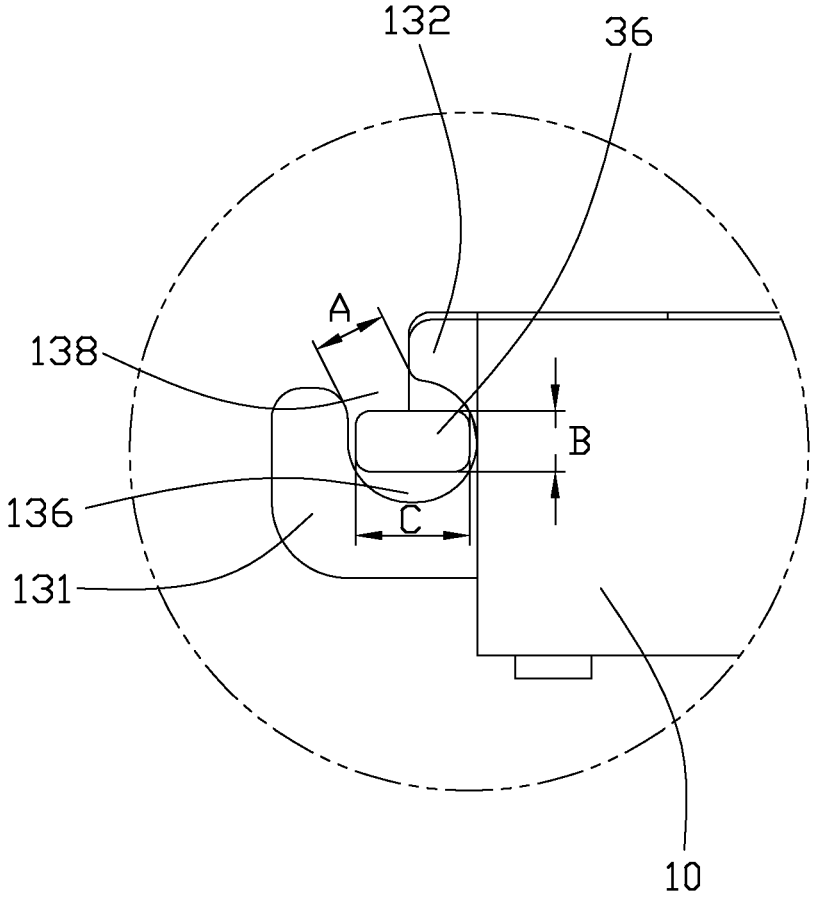
FIG. 6 is an enlarged view of a part of the socket in FIG. 5 surround by a circle line, showing a pick up cap of the socket is located at a horizontal position, and the pivot of the pick up cap stays in a mounting hole of the insulative housing.
Figure 7:
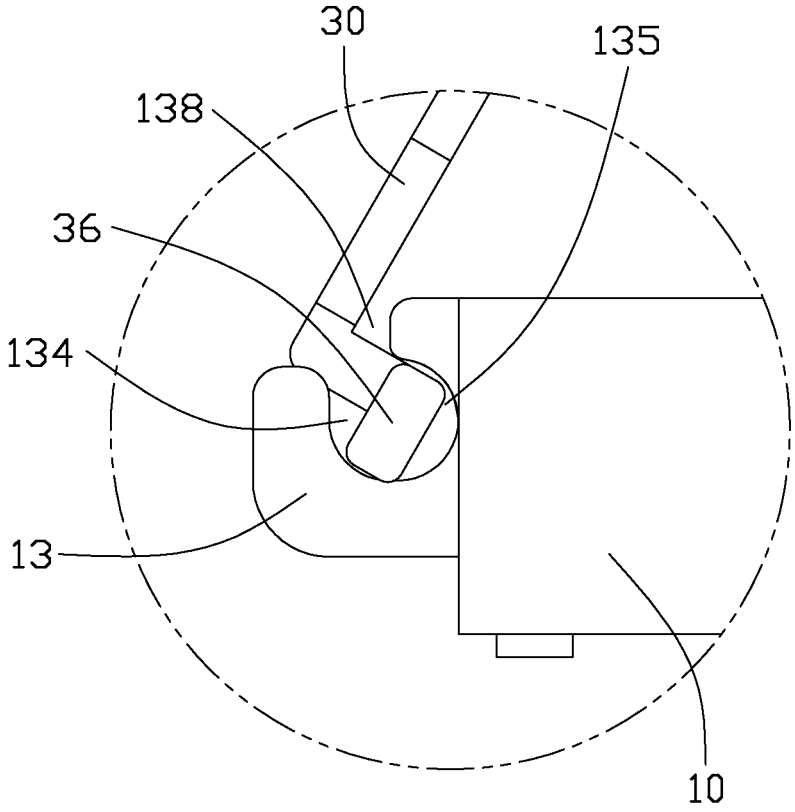
FIG. 7 shows a middle position of the pivot in the mounting hole.
Figure 8:
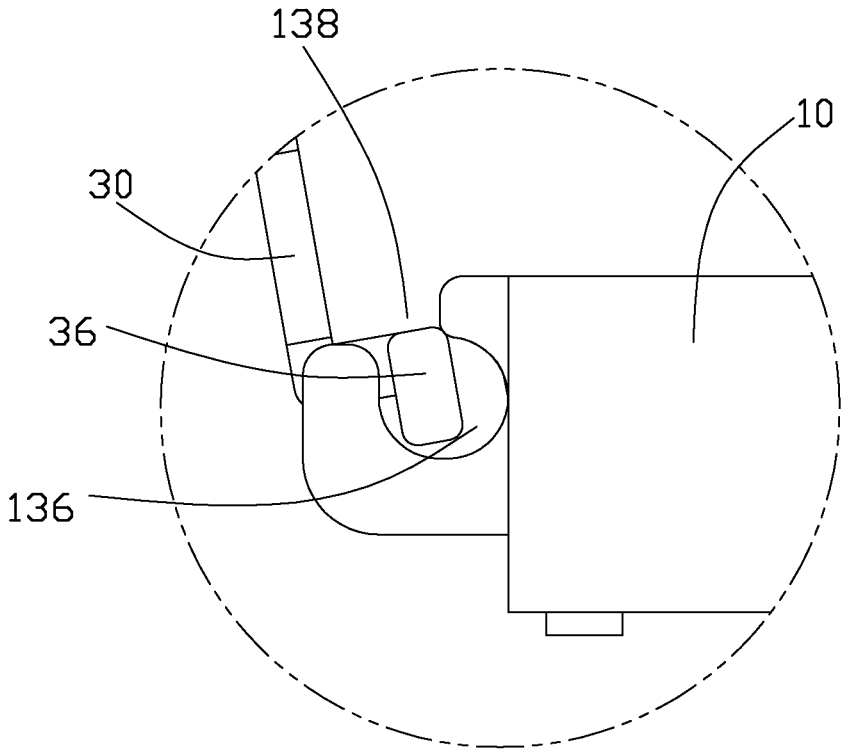
FIG. 8 shows the leaving position of the pivot in the mounting hole when the pick up cap is removed.
Figure 9:
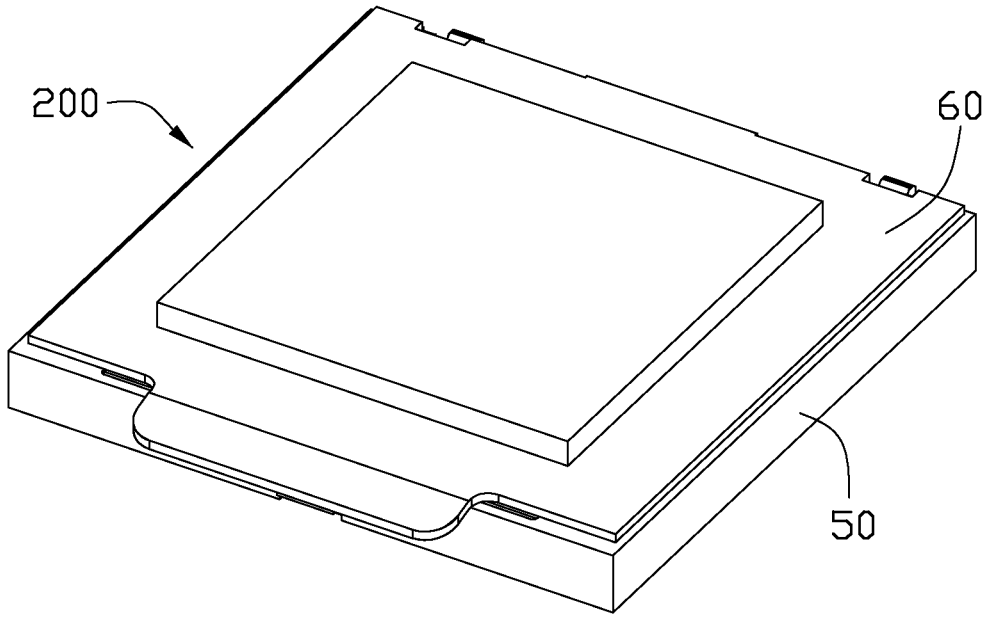
FIG. 9 is an assembled, perspective view of a socket according to a second embodiment of the present invention.
Figure 10:
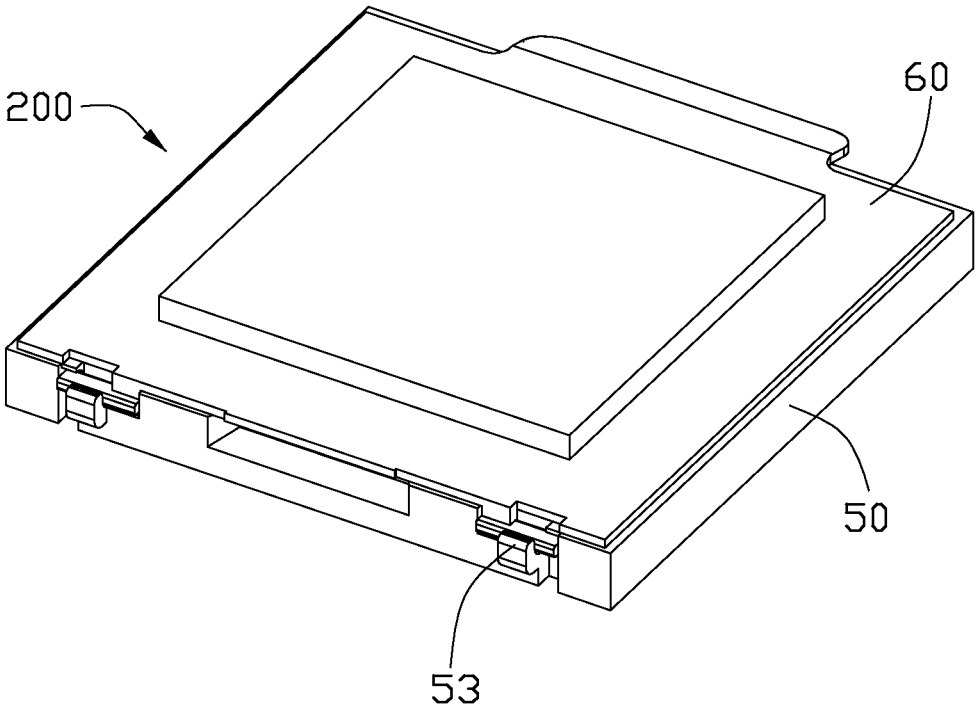
FIG. 10 is a view similar to FIG. 9, while taken from a different aspect.

FIGS. 6-8 shows a removing process of the pivot 36 of the pick up cap 30 from the mounting hole 136. The mounting hole 136, cooperatively defined by the first recess 134 and the second recess 135, has a gap 138. The gap 138 has a width A, a short side of the pivot 36 has a dimension B and a long side of the pivot 36 has a dimension C, wherein C>A>B.

Referring to FIG. 6, when the pivot 36 located at the horizontal position, the long side of the pivot 36 faces the gap 138, since the dimension A of the gap 138 is smaller than the dimension C of the long side of the pivot 36, the pivot 36 at this position can not escape from the mounting hole 136 and is kept to rotate within the mounting hole 136. FIG. 7 shows a middle position; the long side of the pivot 36 still faces the gap 138. After continuing to rotate, the short side of the pivot 36 faces the gap 138 as shown in FIG. 8, and since the dimension A of the gap 138 is bigger than the dimension B of the short side of the pivot 36, so the operator can easily upwardly remove the pivot 36 from the mounting hole 136 via the gap 138 so as to detach the pick up cap 30 from the insulative housing 10. An assembling process of the pick up cap 30 to the insulative housing 10 is a reverse process, here will say again.

FIGS. 9 to 13 describe a socket 200 according to a second embodiment of present invention, the socket 200 has an insulative housing 50 receiving a plurality of contacts (not shown) and a pick up cap 60 secured to the insulative housing 50. The pick up cap 60 has a configuration substantially same with the pick up cap 30 in the first embodiment, and comprises a planar main body 61 disposed upon the insulative housing 50 and an operating portion 62 located on a side of the main body 61 and having a latching arm 63. The main body 61 is formed with a pair of pivots 66 on an edge thereof opposite to the operating portion 62, the pivot 66 is disposed below the main body 61 and horizontally extending along the edge. The pivot 66, the operating portion 62 and the latching arm 63 are same as corresponding sections of the pick up cap 30, unnecessary description will not given here.

Figure 11:
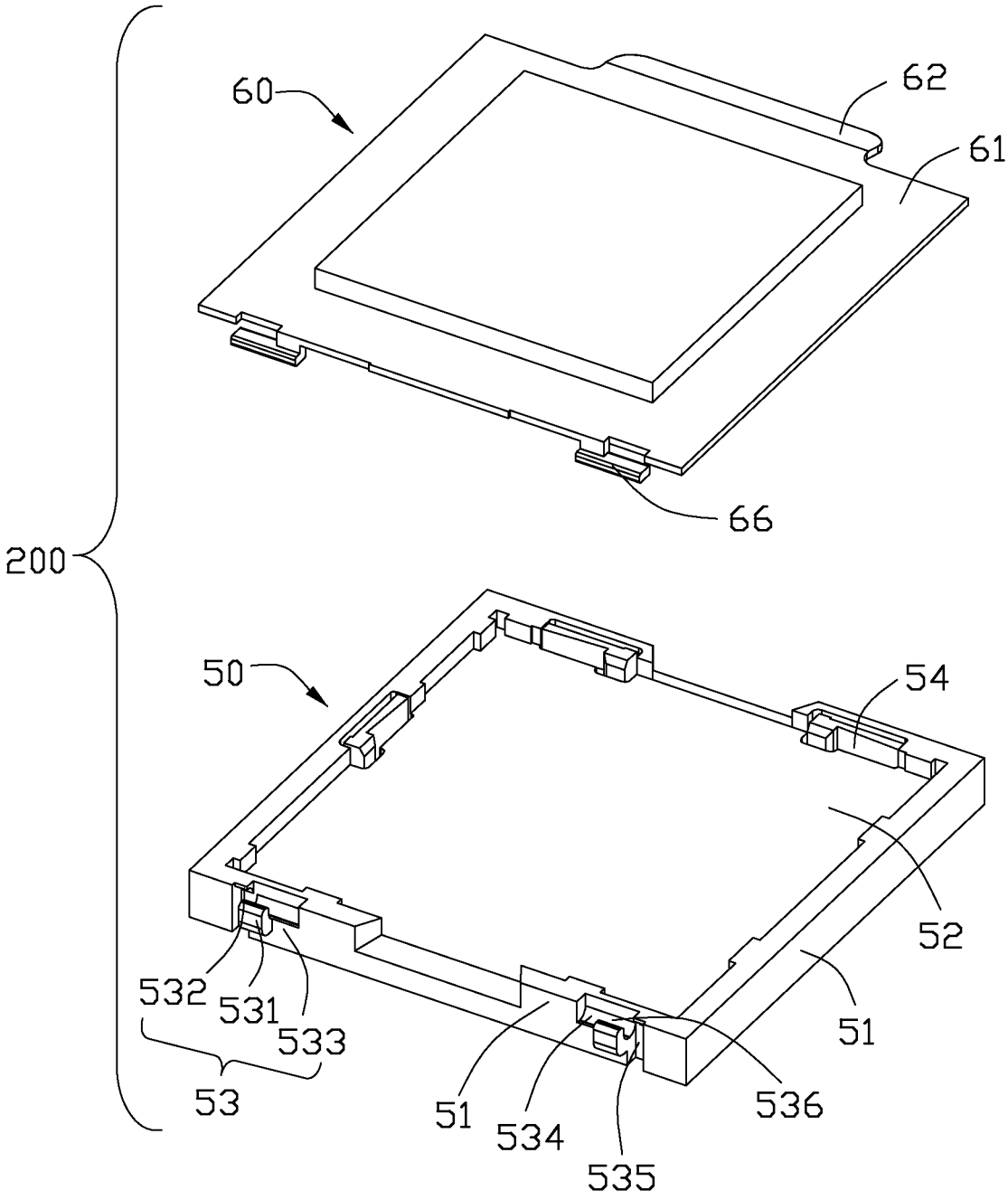
FIG. 11 is an exploded, perspective view of the socket.
Figure 12:
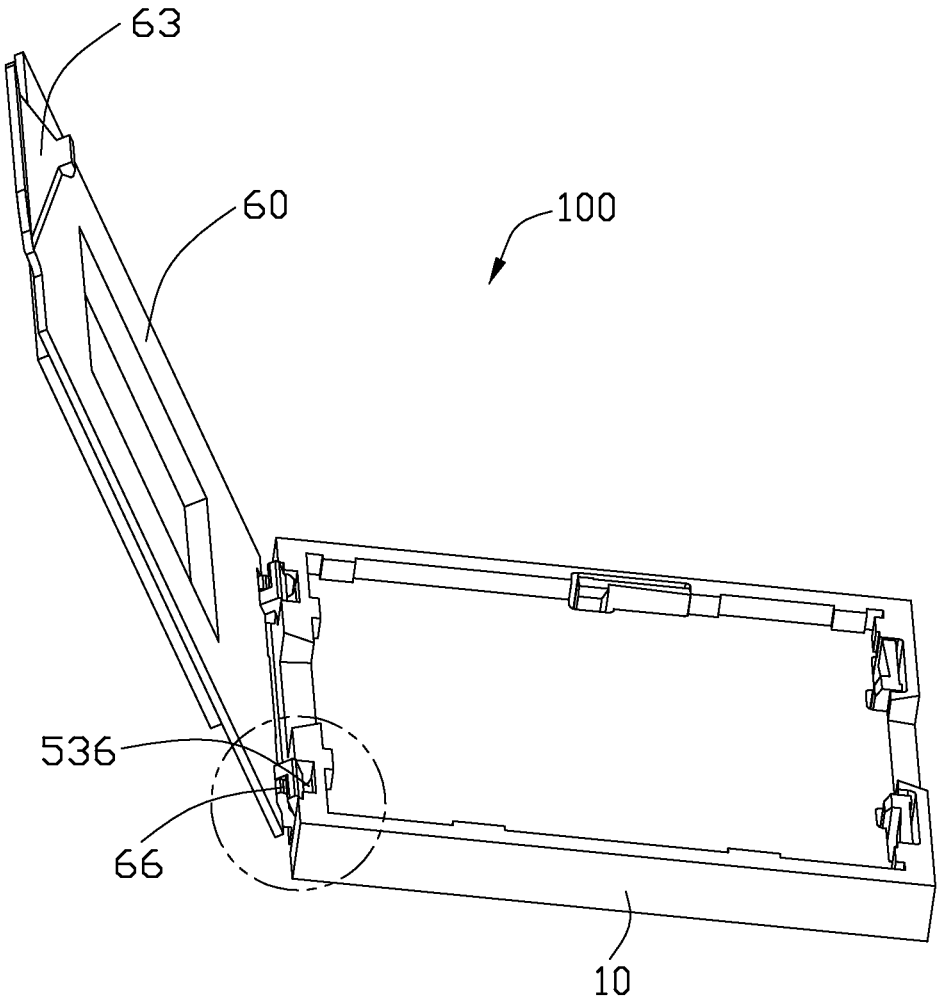
FIG. 12 is another perspective view of the socket in FIG. 10 in an opening state.
Figure 13:
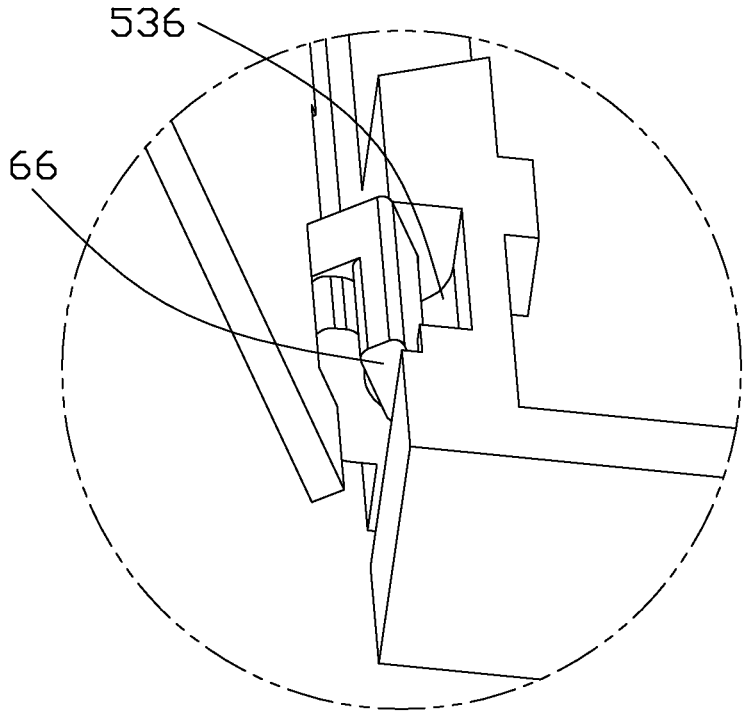
FIG. 13 an enlarged view of a part of the socket in FIG. 12 surround by a circle line.

Referring to FIG. 11, the insulative housing 50 has a same configuration as that of the insulative housing 10. The insulative housing 50 has a plurality of sidewalls 11 extending upwardly from a peripheral thereof, and a receiving cavity 52 recessed downwardly from the top surface thereof, the contacts are arranged in matrix in the receiving cavity 52. The insulative housing 50 has a pair of mounting seats 53 outside two ends of one of the sidewalls 51 to assemble the pick up cap 60.

The sidewall 51 is further provided with an elastic arm 54 to position the IC package in the receiving cavity 52. A difference between the insulative housing 50 in this embodiment and the insulative housing 10 in the first embodiment is: the mounting hole 136 is completely located outside the sidewall 11, while a mounting hole 536 defined by the mounting seat 53 has a part located inside the sidewall 51. The detail configuration of the mounting hole 536 will described in following paragraph.

The mounting seat 53 has a base 531 and an accessorial seat 532, the base 531 protrudes outwardly from outside surfaces of the sidewall 51. The sidewall 51 defines a horizontal slot 534 extending along an extending direction of the sidewall 51 from a part thereof facing the base 531, the horizontal slot 534 passes through a top surface of the sidewall 51 and has arch bottom. The sidewall 51 further has an upright slot 535 located outside the horizontal slot 534 and communicating with the horizontal slot 534. The upright slot 535 passes through a bottom surface of the sidewall 51, a part of the sidewall 51 located at a top of the upright slot 535 forms the accessorial seat 532.

A part of the sidewall 51 located under the horizontal slot 534 forms a bottom seat 533, the bottom seat 533, the base 531 and the accessorial seat 532 together define the mounting hole 536. Since the horizontal slot 534 make a part of the mounting hole 536 inside the sidewall 51, a size of the insulative housing 10 can be reduced. The mounting hole 536 has a gap (not labeled), engagement between the pivot 66 and the mounting hole 536 is same as that of the pivot 36 and the mounting hole 136, here will not say again.

The mounting seat 13 and 53 of the socket 100, 200 in a first and a second embodiments, respectively, the pivot 36, 66 of the pick up cap 30, 60 can be disposed by one or two, both can assemble the pick up cap 30,60 to the insulative housing 10, 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A socket comprising:

an insulative housing receiving a plurality of contacts, the insulative housing having a plurality of sidewalls and at least one mounting seat formed on one of the sidewalls and defining a mounting hole with a gap; and a pick up cap assembled to the insulative housing, the pick up cap formed with at least one pivot disposed on a side thereof, the pivot inserting into the mounting hole via the gap to pivotally assemble the pick up cap to the insulative housing.

2. The socket as claimed in claim 1, wherein the mounting seat has a base and an accessory seat which both extend outwardly from the sidewall of the insulative housing.

3. The socket as claimed in claim 2, wherein the base has a first recess with an upwardly opening, and the accessory seat has a second recess with a downwardly opening, the first and the second recesses cooperatively forms the mounting hole, the mounting hole is located outside the sidewall.

4. The socket as claimed in claim 1, wherein the mounting seat has a base protruding outwardly from the sidewall, the sidewall of the insulative housing defines a horizontal slot from a part thereof facing the base, the horizontal slot passes through a top surface of the sidewall and has arch bottom.

5. The socket as claimed in claim 4, wherein the insulative housing further defines an upright slot communicating with the horizontal slot and passing through a bottom surface of the sidewall, the sidewall forms an accessory seat at a part thereof above the upright slot, and a bottom seat at a part thereof under the horizontal slot, so that the base, the bottom seat and the accessory seat together define the mounting hole.

6. A socket comprising:

an insulative housing having a plurality of sidewalls and a pair of mounting seats, the mounting seats located on one of the sidewalls and defining a mounting hole which substantially having a circular section with a gap; and a pick up cap assembled to the insulative housing, the pick up cap formed with a pair of pivots pivotally received in the mounting hole, the pivots substantially having a rectangular shape with a long side and a short side, and the pivot inserting into the mounting hole via the gap when the short side faces the gap and limited in the mounting hole when the long side faces the gap.

7. The socket as claimed in claim 6, wherein the mounting seat has a base and an accessory seat, both of the base and the accessory seat extend outwardly from the sidewall of the insulative housing.

8. The socket as claimed in claim 7, wherein the base has a first recess with an upwardly opening, and the accessory seat has a second recess with a downwardly opening, the first and the second recesses cooperatively forms the mounting hole, the gap is defined between the base and the accessory seat.

9. The socket as claimed in claim 6, wherein the mounting seat has a base protruding outwardly from the sidewall, the base and the sidewall of the insulative housing cooperatively defines the mounting hole therebetween.

10. The socket as claimed in claim 9, wherein the sidewall of the insulative housing defines a horizontal slot from a part thereof facing the base, the horizontal slot passes through a top surface of the sidewall and has arch bottom.

11. The socket as claimed in claim 10, wherein the insulative housing further defines an upright slot communicating with the horizontal slot and passing through a bottom surface of the sidewall, the sidewall forms an accessory seat at a top part thereof above the upright slot, and a bottom seat at a bottom part thereof under the horizontal slot, so that the base, the bottom seat and the accessory seat together define the mounting hole.

* * * * *